United States Patent [19]

Esser

[11] Patent Number: 4,534,613

[45] Date of Patent: Aug. 13, 1985

[54] RECEPTACLE TERMINAL HAVING LOCKING LANCE

[75] Inventor: Wilhelm C. J. Esser, Tilburg, Netherlands

[73] Assignee: AMP Incorporated, Harrisburg, Pa.

[21] Appl. No.: 547,277

[22] Filed: Oct. 31, 1983

[51] Int. Cl.[3] ..... H01R 13/12

[52] U.S. Cl. ..... 339/258 S

[58] Field of Search ..... 339/256 SP, 258 S

[56] References Cited

U.S. PATENT DOCUMENTS 4,478,470 10/1984 Fruchard et al. ..... 339/258 S

FOREIGN PATENT DOCUMENTS 223876 12/1963 Netherlands ..... 339/256 SP

*Primary Examiner*—Joseph H. McGlynn

*Attorney, Agent, or Firm*—F. W. Raring

[57] ABSTRACT

Receptacle terminal has substantially flat web portion and has contact springs which extend in one direction from the side edge portion of the web. The contact springs extend inwardly over the web and have end portions which are spaced from the web and which engage an inserted tab. A first pair of positioning ears are provided at the mating end of the terminal and extend inwardly of the web and towards each other. A second pair of positioning ears are formed from the contact springs and extend towards each other. The positioning ears locate a tab centrally on the web. A locking lance is struck from the web and serves to lock an inserted tab to the receptacle.

3 Claims, 4 Drawing Figures

RECEPTACLE TERMINAL HAVING LOCKING LANCE

FIELD OF THE INVENTION

Figure 1:
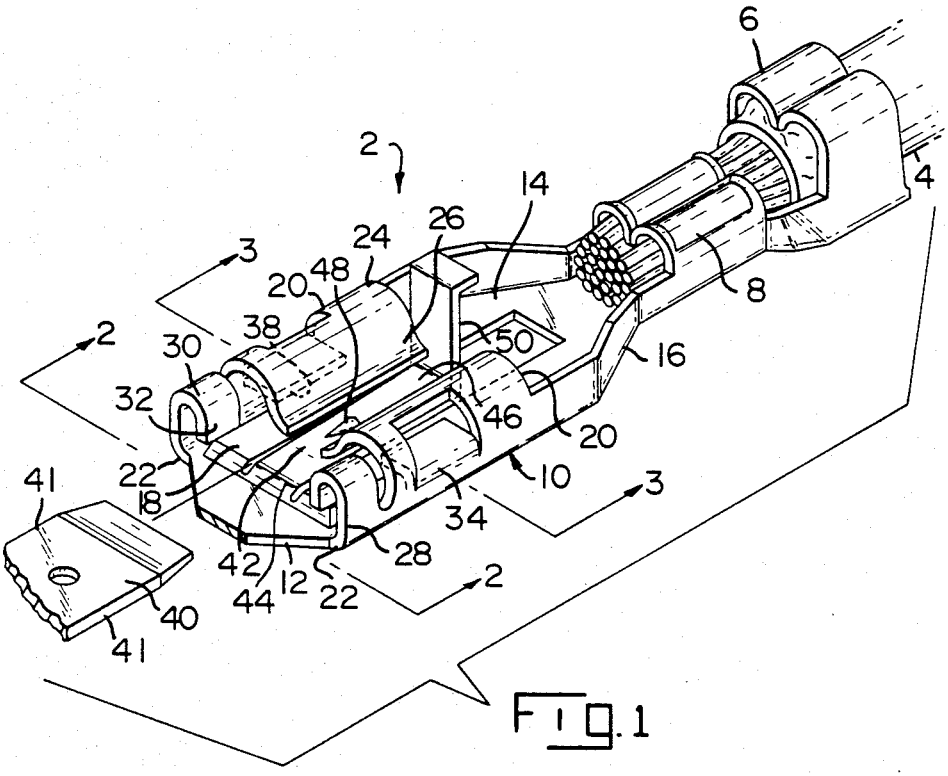

This invention relates to electrical receptacle terminals of the type intended to receive a flat rectangular terminal tab and particularly receptacle terminals having a locking lance for locking the tab to the receptacle when it is inserted.

BACKGROUND OF THE INVENTION

A commonly known type of receptacle terminal comprises a flat or substantially flat web portion having contact springs extending from its marginal side edge portions. The contact springs extend normally of the web and then inwardly and over the surface of the web so that when the tab is inserted into the space between the contact springs and the surface of the web, the tab will be electrically connected to the receptacle. Receptacle terminals of this type can also be provided with a locking lance which struck from the web and which extends obliquely from the plane of the web. The lance has a dimple or other locking means on its surface which engages the inserted tab to secure the tab to the terminal.

Tab-type terminals intended to be mated with receptacles as described above are manufactured in two standard widths, 4.7 mm and 2.8 mm. Heretofore receptacle terminals having locking lances have only been manufactured for terminal tabs having the greater width, 4.7 mm, for the reason that it is impractical to simply scale down or reduce the size of the receptacle and the locking lance so that the receptacle will accept a terminal tab having a width of 2.8 mm. If the larger receptacle is scaled down and if the terminal tab is also scaled down, or it is reduced in width and becomes so flimsy that it cannot serve its intended function. The present invention is directed to the achievement of a receptacle terminal having a locking lance and which is dimensioned to receive the smaller standard tab having a width of about 2.8 mm.

An electrical receptacle terminal in accordance with the invention comprises a flat web portion extending from the mating end of the terminal to the inner end thereof. The web portion has side edges and has contact springs extending from the side edges, the contact springs being formed inwardly so that they are over one surface of the web. When a tab is inserted into the space between the contact springs and the surface of the web, the springs will engage the terminal tab and establish electrical contact. A receptacle terminal in accordance with the invention is characterized in that a first pair of tab positioning ears are provided at the mating end of the terminal and a second pair of tab positioning ears are provided intermediate the ends of the terminal. The first and second pairs of positioning ears are effective to engage the side edges of an inserted tab and locate the tab centrally on the web. The first pair of tab positioning ears comprises flanges extending normally from the side edges of the web which are reversely bent and which have end portions that extend towards the web. The end portions of the flanges have opposed guiding surfaces which guide the tab onto the web during the initial stages of insertion of the tab into the receptacle. The contact springs extend from the marginal side portions of the web intermediate the ends of the web and the second pair of positioning ears are struck from the contact springs and extend from the marginal side portions of the web inwardly thereof and towards each other. This second pair of positioning ears has opposed guiding edges at their free ends which are co-planar with the guiding surfaces of the first pair of positioning ears.

A further embodiment is characterized in that a locking lance is struck from the web centrally thereof for locking inserted tab to the terminal, the locking lance having a fixed end which is integral with the web and proximate to one end of the web. The locking lance has a free end which is proximate to the other end of the web and extends obliquely from its fixed end away from the first surface of the web and is centrally located on the web. The marginal free end portions of the contact springs overlap the locking lance and the parallel guiding surfaces and the opposed guiding edges of the first and second pairs of positioning ears are spaced from the side edges of the locking lance.

THE DRAWINGS

FIG. 1 is a perspective view showing a receptacle terminal in accordance with the invention with a terminal tab in alignment with the mating end of the receptacle terminal.

Figure 2:
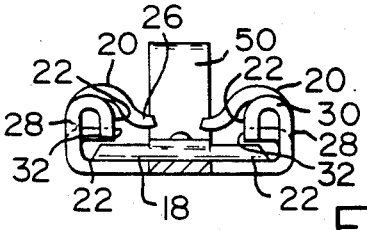
Figure 3:
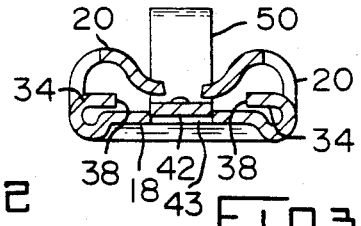

FIGS. 2 and 3 are views taken along the lines 2—2 and 3—3 of FIG. 1.

Figure 4:
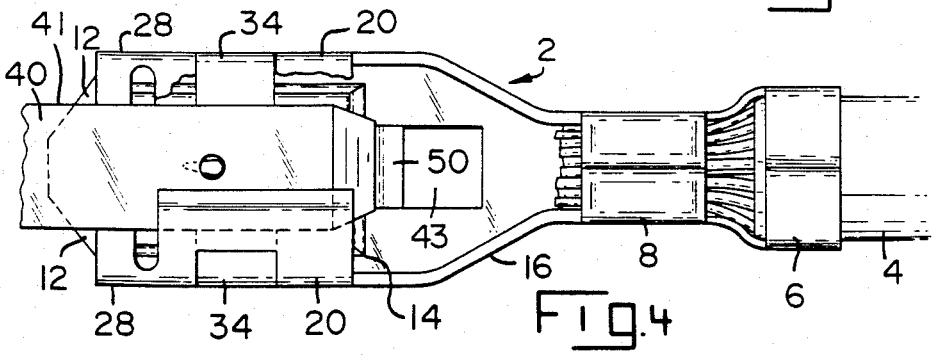

FIG. 4 is a view showing the tab inserted into the receptacle and illustrating the function of the positioning ears.

A receptacle terminal 2 in accordance with the invention is crimped onto an insulated wire 4 by means of an insulation crimp 6 and a wire crimp 8 which establishes electrical contact between the terminal and the metallic core of the wire. The terminal 2 is of stamped and formed conductive sheet metal and has a receptacle portion 10 which receives a rectangular tab 40. The terminal has a mating end 12, and inner end 14, and a transition section 16 which extends from the inner end to the crimped portion 8.

The receptacle portion 10 comprises a web 18 which extends from the mating end 12 to the inner end 14. Contact springs 20 extend from the marginal side portions of the web intermediate the ends 12, 14, and extend inwardly as shown at 24 and then downwardly towards the upper surface of the web. The contact springs have free end portions 26 which are located above the upper surface of the web and which engage the tab 40 upon insertion.

The receptacle portion 10 has a width as measured between its marginal side portions 22 which is substantially greater than the width of the tab 40 as measured between its side edges 41. It is therefore necessary to provide first and second pairs of positioning ears 28, 34, for locating the tab centrally on the surface of the web. The first pair of positioning ears 28 are provided at the mating end 12 of the receptacle and comprise flanges which extend normally from the side portions of the web and which are reversely bent through an angle of 180 degrees as shown at 30 so that their end portions extend normally towards the web. This first pair of positioning ears has opposed parallel surfaces 32 which guide the tab during the initial stages of insertion into the receptacle.

The second pair of positioning ears 34 are formed or struck from the contact springs 20 and extend from the marginal side portions 22 of the web, normally of the plane of the web. These ears are then bent through an angle of 90 degrees so that their end portions extend parallel to the web and close to the surface of the web. The ears 34 have opposed edges 38 which are spaced apart by the same distance as are the surfaces 32. The second pair of ears guides the tab during the final stages of insertion and both pairs of ears cooperate to maintain the tab centrally with respect to the receptacle after insertion has been completed.

A locking lance 42 is struck from the web and has a fixed end 44 which is adjacent to the mating end 12 the receptacle. The lance extends obliquely from the upper surface of the web and towards the inner end 14 of the web and above the opening 43 in the web. The free end 46 of the lance is thus spaced above the surface of the web but can be moved down into the opening when a tab is inserted. During insertion, a dimple or other projection 48 on the lance enters an opening in the tab thereby to lock the lance to the receptacle. When it is desired to release the tab, a release arm 50 which extends upwardly from the end of the lance is pressed downwardly until the dimple 48 moves out of the opening in the tab.

A distinct advantage achieved in the practice of the invention is that it permits the manufacture of receptacle terminals of the general type shown having a locking lance for relatively narrow tab terminals as shown at 40. When the tab is relatively wide, for example, 4.7 mm, the receptacle would be of the size shown in the drawing but the positioning ears would not be provided and the tab after insertion would substantially occupy the space between the normally extending sidewalls of the contact springs. The lance would also be of the size shown and this lance must be of some minimum width if it is to serve its intended function.

The lance cannot be made much smaller than that shown in the drawing. The provision of the positioning ears thus permits the coupling of a narrow terminal tab 40 to a receptacle which is relatively wide and the locking lance can be correspondingly wide so that it is sturdy enough to perform its intended function. The principles of the invention are also useful in that one stamping die can be used for producing receptacles intended to receive tabs 40 having a width of 2.8 mm, end tabs having a width of 4.7 mm. When receptacles for the larger tabs are being manufactured minor die changes are made so that the positioning ears will not be formed in the receptacle.

I claim:

1. An electrical receptacle terminal which disengageably receives a rectangular tab terminal having parallel side edges, the receptacle terminal having a mating end and an inner end, a flat web portion extending from the mating end to the inner end, the web portion having side edges and having contact springs extending from the side edges, the contact springs extending normally from the side edges and being formed inwardly towards each other and towards one surface of the web, the contact springs having marginal free end portions which are spaced from the one surface of the web by a distance which is less than the thickness of the tab whereby upon movement of the tab terminal into the receptacle, the free edge portions of the springs will press the tab against the web, the electrical receptacle terminal being characterized in that:

a first pair of tab positioning ears are provided at the mating end of the terminal and a second pair of tab positioning ears are provided intermediate the ends of the terminal, the first and second pairs of positioning ears being effective to engage the side edges of an inserted tab and locate the tab centrally on the web, the first pair of tab positioning ears comprising flanges extending normally from the side edges of the web, the flanges being reversely bent and having end portions which extend towards the web, the flanges having opposed parallel guiding surfaces which guide the tab onto the web during insertion, the contact springs extend from the side edges of the web intermediate the ends of the web, the second pair of positioning ears being struck from the contact springs and extending from the side edges of the web inwardly thereof and towards each other, the second pair of positioning ears having opposed guiding edges at their free ends which are co-planar with the guiding surfaces of the first pair of positioning ears.

2. An electrical receptacle terminal as set forth in claim 1 characterized in that a locking lance is struck from the web for locking an inserted tab to the receptacle terminal, the locking lance having a fixed end which is integral with the web proximate to one end of the web and having a free end which is proximate to the other end of the web, the locking lance extending obliquely from its fixed end away from the one first surface of the web and being centrally located on the web, the marginal free end portions of the contact springs overlapping the locking lance, the parallel guiding edges of the first and second pairs of positioning ears being spaced from the locking lance.

3. An electrical receptacle terminal as set forth in claim 2 characterized in that the fixed end of the locking lance is proximate to the mating end of the receptacle terminal.

* * * * *